US005626330A

United States Patent [19]

Young

[11] Patent Number: 5,626,330

[45] Date of Patent: May 6, 1997

[54] BARRICADE SYSTEM

[76] Inventor: Ferris F. Young, 6341 Ocotillo Ave., Apt. G, Twentynine Palms, Calif. 92277

[21] Appl. No.: 533,437

[22] Filed: Sep. 25, 1995

[51] Int. Cl.[6] ..... E04H 17/00

[52] U.S. Cl. ..... 256/19; 256/1

[58] Field of Search ..... 256/1, 23, 24, 256/DIG. 2, 19

[56] References Cited

U.S. PATENT DOCUMENTS

| | | | |
|---|---|---|---|
| 511,973 | 1/1894 | Stevens . | |
| 517,601 | 4/1894 | Cary . | |
| 3,223,387 | 12/1965 | Magliocco | 256/1 |
| 4,524,953 | 6/1985 | Phillips et al. | 256/23 |
| 4,533,122 | 8/1985 | Bannister | 256/1 X |
| 4,953,852 | 9/1990 | Donohue | 272/78 |
| 5,069,311 | 12/1991 | Young | 188/32 |
| 5,076,546 | 12/1991 | Henry | 256/24 |
| 5,230,187 | 7/1993 | Reimann | 256/1 X |
| 5,265,374 | 11/1993 | Crane | 256/1 X |
| 5,291,708 | 3/1994 | Johnson | 256/24 X |
| 5,294,472 | 3/1994 | Arnold et al. | 428/120 |
| 5,460,353 | 10/1995 | Rittenhouse | 256/1 |

FOREIGN PATENT DOCUMENTS 472119 9/1937 United Kingdom .

*Primary Examiner*—Anthony Knight
*Attorney, Agent, or Firm*—Paul Adams

[57] ABSTRACT

A temporary barrier system particularly adapted for use in or around a home in which children who are learning to walk are provided with wheeled vehicles that may be propelled by the child and run or bumped into furniture or other valuable objects. The protection system includes two elements: an elongated bar and a stanchion or supporting member. The stanchions are provided with some means for resisting movement from the position in which they are initially placed. The stanchion has a plurality of openings or slots which are designed to support the ends of the elongated bars. At least two of the openings are perpendicular to one another; others are formed at acute angles to the perpendicularly disposed openings. The cross section of the slot and the elongated bar are designed so that the bar fits tightly in the slot providing some rigidity to the assembly. By placing elongated members of different length in slots at different angles, a variety of shapes may be formed.

19 Claims, 2 Drawing Sheets

BARRICADE SYSTEM

BACKGROUND AND PRIOR ART

This invention relates to a system for protecting an object from contact by a moving vehicle.

A general problem that occurs in a wide variety of contexts is the establishment of a relatively temporary barrier or fence around an object so that vehicles or persons are prevented from approaching the protected object.

The present invention addresses a particular genre of this general problem that arises when a child, in a home, patio, or other area, uses what is often referred to as a training-walker which is a wheeled vehicle in which the child can sit or stand and which provides support while learning to walk. By virtue of the fact that such child has little control over its movements or the movement of the vehicle, the child can run the vehicle into various objects which are of value, such as furniture, causing damage. While it may be possible to place bumpers on the objects or other means for preventing the vehicle from colliding with the object, it is desirable to remove such fence or bumpers when the child is not using the training-walker. A number of the problems that are specific to protection of furniture or other objects within a house from the use of a training-walker or infant exerciser are related in my earlier U.S. Pat. No. 5,069,311. It only bears repeating here that in addition to the problems of damaging objects as related above, the use of a child training-walker can also present danger to the child if a barrier is not established to prevent the child from propelling herself downstairs, off a ledge, or into a hole.

With reference to my earlier invention, the barrier there described comprises an elongated stop member that rests on the horizontal surface on which the vehicle is operated. The barrier is of a finite length and constructed in sections that may be disposed around the area to be protected. Each of the sections are independently secured to the floor through the various means there disclosed depending on whether the floor is a flat hard surface such as wood or concrete, or a carpet covered surface. In such invention there is no relationship between the individual sections which do not cooperate in any manner. Accordingly, if one of such sections becomes loose from the floor, it may be easily pushed aside by the vehicle thereby allowing collision. Furthermore, I have found that securing each section of the stop member cannot be accomplished as quickly and as easily as desired to have a truly temporary barrier that can be moved often when its use is not required.

Beyond my specific earlier solution for a temporary barrier system for preventing movement of a child propelled vehicle, there are other prior art barrier systems such as those used to block a street which may use the well-known sawhorse to support a horizontal stop member in a position above the road surface to prevent a vehicle from passing. And of course it is not uncommon to see a row or series of these sawhorse barriers to provide an elongated fence. Other variations of the sawhorses used in street barrier systems include a concrete pyramid having an opening near its upper end through which an elongated stop member such as a 2×4 piece of lumber can be supported at each end by a pair of these concrete stanchions. Yet these street barrier systems require a support member at each end and therefore when placed in line still require two support members at all intermediate positions of the fence. Even where the concrete pyramid stanchion is employed, and the opening is made large enough for the ends of more than one 2×4 to be supported by a single stanchion, the fence must be disposed along a generally linear path. And the 2×4 bars are not adapted for resisting any real collision, as in the case of the child using a training walker.

It is therefore an object of the present invention to provide a temporary barrier system for use in a variety of applications which can be easily assembled and disassembled with a minimum of effort and time.

It is a further object of the present invention to provide a temporary barrier system particularly adapted for preventing the movement of a child propelled vehicle, that can be set up like a fence but which may have an irregular shape.

It is a further object to provide such movement preventing system in which the elements are quickly and firmly interlocked so that the elongated stop members and the members supporting the stop members create a rigid though irregularly shaped fence.

Yet another object of the present invention is to provide a temporary barrier system that is relatively inexpensive and can be sold in kit form so as to meet the requirements of a large variety of users in various environments.

Additional objects and advantages of the present invention will become apparent from the following description including the drawings.

A BRIEF DESCRIPTION OF THE DRAWINGS

DESCRIPTION OF THE PREFERRED EMBODIMENT

Figure 1:
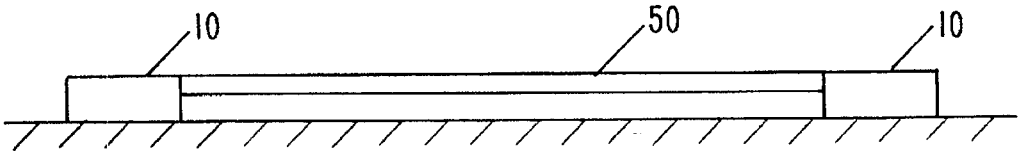
FIG. 1 is a front elevation view of one section of a temporary barrier system constructed in accordance with the present invention.

Referring now to FIG. 1, there is shown one section of a barricade system constructed in accordance with the present invention including two principal elements, a stanchion, post or supporting means 10 and stop means comprising an elongated bar 50. The supporting means 10 rests on a horizontal surface such as a floor of a house or building.

Figure 2:
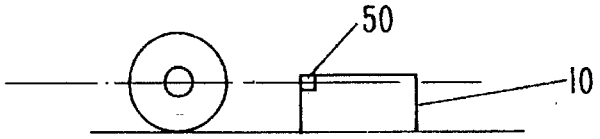
FIG. 2 is a side elevation view of the barrier shown in FIG. 1 including a wheel of a vehicle which the barrier is intended to stop.

As seen in FIG. 2, the stop means 50 is supported above the floor surface at a distance which, preferably, is at or above the center line of the vehicle which the barricade system is designed to stop. It will be apparent that each stanchion 10 could be any height and the stanchion 10 could be designed so as to be telescoping or otherwise extendable so as to support the stop means 50 at a desired height above the surface.

Figure 3:
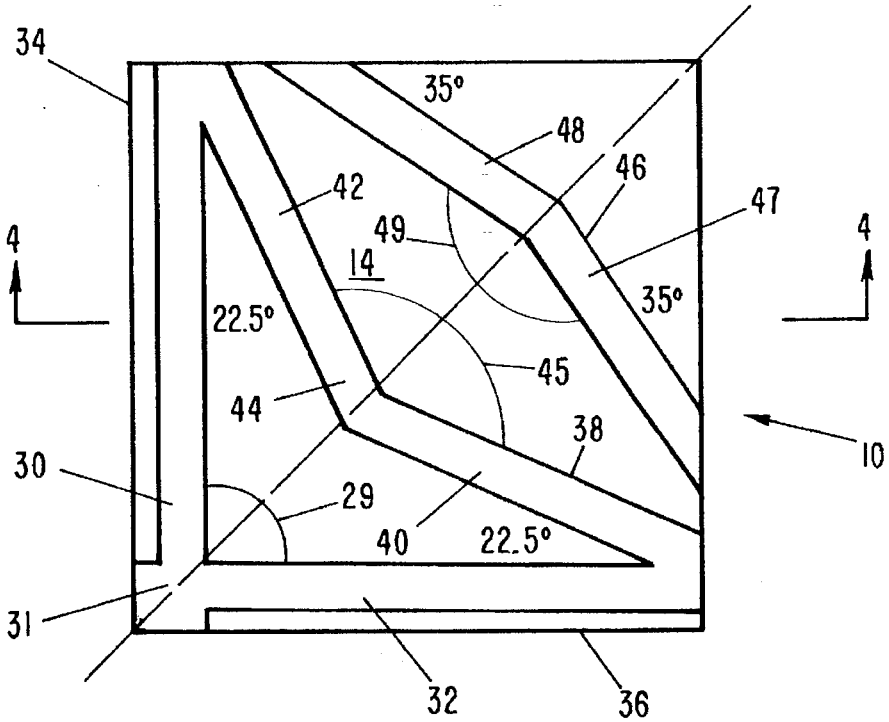
FIG. 3 is a top plan view of the stanchion of the present invention.
Figure 4:
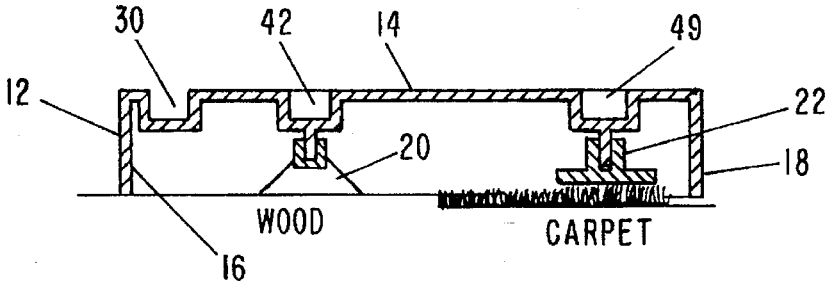
FIG. 4 is a sectional view of the stanchion.
Figure 5:
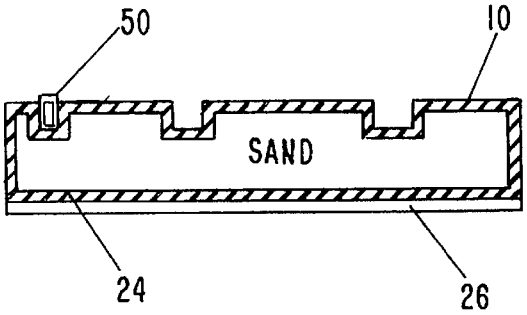
FIG. 5 is an alternative construction of the lower section of the stanchion shown in FIG. 4.

Turning now to FIGS. 3 through 5, the stanchion 10 is shown in greater detail. In the preferred embodiment, the stanchion is of generally rectangular shape having a top section 12 including a top wall 14, and side walls, two of which can be seen at 16 and 18.

In the embodiment shown, the top wall and side walls are molded as a single plastic piece but it will be obvious that various constructions may be utilized including wood, steel, concrete, and the like. In the embodiment shown in FIG. 4, the stanchion 10 is secured to the floor by one of several means such as the suction cup 20 that depends downwardly from the top wall 14 and is adapted for securing the stanchion 10 to a wooden floor. Alternatively, there is shown at another location within the body of the stanchion 10 and also depending from the top wall 14, a plate 22 which includes one-half of a VELCRO® securing means, the other half comprising the carpeting to which the other member is secured.

In the second embodiment shown in FIG. 5, the lower end or section of the stanchion 10 is enclosed by a bottom wall 24 so as to form an enclosed body. To provide weight to the stanchion, an opening may be provided in any of the side walls to permit the molded stanchion body to be filled with liquid, sand, pellets, etc. The bottom wall 24 of the stanchion 10 has a lower surface to which is secured an anti-skid material 26. The combination of the weight and the anti-skid material is highly effective for maintaining the stanchion in place on a wooden floor or other relatively smooth flat surface. Like the suction cup or the VELCRO® attachment, the anti-skid member 26 enables the stanchion or post to resist movement from the initial position in which it is located.

Returning now to FIG. 3, it will be seen that the upper portion 12 of the stanchion 10 is formed with a plurality of slots or channels. The purpose of these slots is to receive the ends of the elongated bar 50 so as to support the bar from the surface on which the stanchions sit. Specifically, in the preferred embodiment, slots 30 and 32, each extending from one edge of the stanchion to the other, intersect at an angle 29 that is substantially 90 degrees. This perpendicular intersection 31 is located, in this embodiment, adjacent one corner of the stanchion. Also in this embodiment, the two slots 30, 32 are parallel to and immediately adjacent the side edges 34, 36 of the stanchion. These slots may intersect at various locations in the upper section 12 of the stanchion 10 although when used as a stanchion for supporting elongated members 50 at a corner of an object to be protected, the positioning of the slots 30 and 32 near the edges 34 and 36 allow an extended portion of the elongated member to rest in the slots.

Other slots are formed in the upper section 12 of the stanchion including slot 38 that has two separate segments 40 and 42. As will be seen in FIG. 3, segment 40 is disposed at an angle to slot 32; in the preferred embodiment, this angle is 22.5 degrees. Similarly, slot 42 in this embodiment is also disposed at a 22.5 degree angle to slot 30. The segments 40 and 42 intersect at 44. The included angle 45 of the segments 40, 42 in this embodiment is greater than 90 degrees but less than 180 degrees. Another slot 46 is formed in the top section 12 and includes two segments 47, 48. Segment 47 is disposed at an angle of 35 degrees to one edge of the stanchion 10 and segment 48 is similarly disposed at an angle of 35 degrees to the adjoining edge. The included angle 49 between segments 47 and 48 is slightly less than 180 degrees.

As will be seen from FIG. 4, all of the slots, channels or depressions that are formed in section 12 of the stanchion have a rectangular cross section in which may rest elongated bar 50 with a matching cross sectional shape. It will also be noted in FIG. 3, that in this preferred embodiment each of the slots are either linear, or comprise two segments each of which are linear and which intersect within the edges of the body of the stanchion.

The elongated member 50 provides means for stopping the movement of a vehicle past the two stanchions on which the elongated member rests. The elongated member has a rectangular cross section as seen in FIG. 5 and is relatively tight fitting or is pressed fit into the slot so that it forms a relatively rigid structural unit with the stanchion. Each of the elongated members 50 may be of different length, or all of the same length, depending upon the particular application for which the barrier system is employed. The elongated member 50 may be a solid rod or may be hollow and may be made from plastic, wood, steel, or other rigid materials that would be satisfactory as means for stopping the movement of a vehicle past the barrier formed by the elongated member and the two supporting stanchions.

Figure 6:
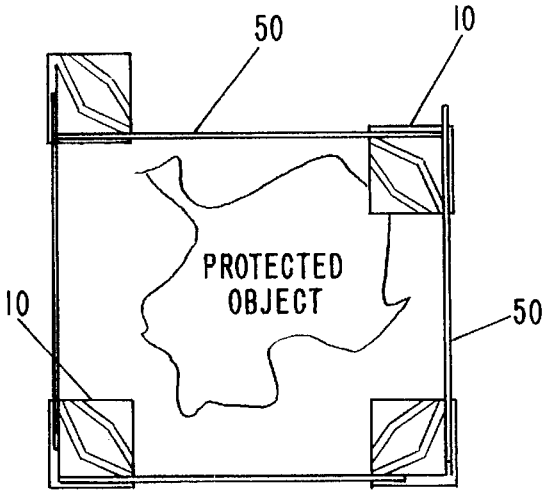
FIG. 6 is an illustration of the barrier system arranged to surround a protected object.
Figure 7:
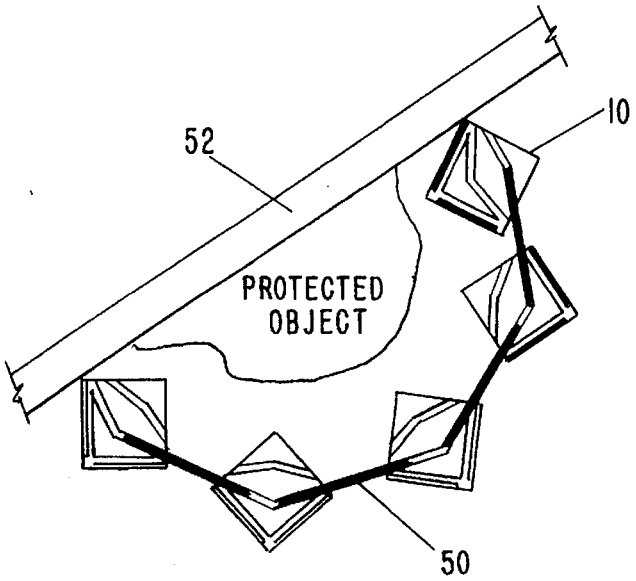
FIG. 7 shows another arrangement of the barrier system to protect an object against a wall.
Figure 8:
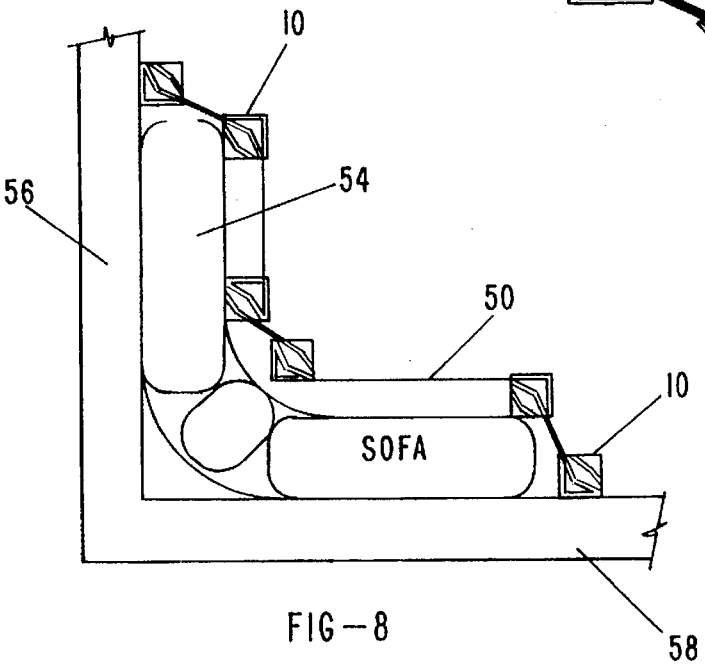
FIG. 8 is a still further representation of a barrier system set in place to protect a sofa in a corner of a room.

Referring now to FIGS. 6 through 8, there are illustrated several temporary barricade systems that were constructed utilizing the two members comprising the system, i.e., the elongated bar and the stanchion. In FIG. 6, an object that is in the middle of the room, such as a table or the like, could be protected by forming a rectangle barricade system in which four stanchions support four elongated bars, the bars being in generally perpendicular relationship to one another. It will be appreciated that the barricade system may be rapidly assembled by simply positioning the stanchions on the floor, and pressing the ends of the elongated member into one channel of each of two stanchions whose slots are aligned for assembly. When the four elongated members are fit in place and rest in the slots of the four stanchions, the components form a relatively stable and rigid barricade system. In this manner, an object that bumps into the elongated bar and continues to apply force to the bar and supporting stanchions must move not merely the two stanchions and the bar which the vehicle is contacting, but must also move the other stanchions and bars in order to disrupt the assembly or move the entire assembly such that the vehicle could then contact the protected object. This is to be contrasted with prior art temporary barrier systems where the horizontal means for stopping movement toward an object is supported only at each end by two stanchions and even where there is a fence formed around a periphery of an object, each corner has two stanchions which are not connected and thereby provide no structural enforcement or integrity to the barrier system as a whole. Of course, the present invention also allows a single stanchion to support two elongated members at each corner thereby eliminating one of the stanchions in many prior art constructions to thereby reduce cost.

Referring now to FIG. 7, another configuration of a barrier system is shown in which an object that is disposed against a wall 52 is protected with a series of stanchions and elongated bars, in this case comprising five stanchions and four bars. It will be noted that in this case rather than building a rectangular barrier, which would encompass a larger area than necessary to protect the object, the slots in the stanchions that are disposed at other than a right angle to the edges of the stanchion are utilized so that the barrier may be formed closer to the protected object and thereby not project as far out into the room, for example, as if a rectangular configuration was used. Finally, there is shown in FIG. 8 another temporary barrier configuration in which a sofa 54 in the corner of a room formed by walls 56 and 58 is protected by forming a temporary barrier using the stanchions and elongated members in this case using both slots that are disposed at angles to the edges of the rectangular stanchion as well as those which are parallel or perpendicular to the edges of the stanchion. Again, the purpose is that by utilizing the angularly disposed slots or channels the barrier may be formed closer to the sofa and thus not project out into the room as far while still providing protection against the errant vehicle.

Another embodiment of a barrier system would allow the bars to be pivotally mounted on each stanchion, with adjacent bars interlocking, for example by telescoping into one another. The system therefore can be irregularly shaped as in the preferred embodiment. However the bars and stanchions, two bars per stanchion, may be permanently attached and making the disassembled system less convenient for storage.

From the above description, it will be appreciated that the objects of the invention are attained through the preferred embodiment described in detail above. However, it should also be appreciated that various changes may be made in the construction of the stop means and the supporting means while retaining the advantages of the invention. For example, rather than slots, channels or depressions in the upper section 12 of the stanchion, other means such as an opening through a solid stanchion midway between the upper and lower wall could be formed by creating openings either rectangular or circular in configuration. The slots or depressions in the upper section of the preferred embodiment while shown as rectangular in cross section could also be circular and thus accept a dowel or pipe.

Nor is it critical that the angles between the slots or segments of the slots that are not perpendicular to one another be at any specific angle. It was found in the preferred embodiment that the angles shown permitted a variety of positions for the stanchion to enable the barrier to be formed closely around the object protected. But deviations from the number of slots, the angular relationship between the slots and/or segments, and the angle of intersection between the segments do not depart from the invention. Furthermore, several different means for securing the stanchion to the surface on which the vehicle rides have been shown but other alternatives will occur to those having ordinary skill in the art. In short, the above description should not be construed as limiting the scope of the invention but merely as an illustration of one form of the invention. The scope of the invention should be determined by the following claims, and the equivalents of the elements and means contained in such claims.

I claim:

1. A barricade system comprising, in combination, at least two elongated stop bars and at least one more stanchion than the number of stop bars, each of said stanchions supporting one end of one of said stop bars above the surface on which the stanchions are placed so as to prevent the movement of a wheeled vehicle beyond the stop bars, each of said stanchions including a plurality of slots for receiving at least a portion of at least one elongated stop bar, at least two of said slots extending from one edge of said stanchion to the other edge and intersecting substantially perpendicularly, at least one other slot intersecting one of said perpendicular slots at an angle less than 90 degrees.

2. The barricade system of claim 1 wherein said stanchion other slot comprises two slot segments, one of said segments intersecting a first of said perpendicular slots at an angle of less than 45 degrees and the second segment intersecting the second of said perpendicular slots at an angle of less than 45 degrees, the intersection of said segments forming an angle of greater than 90 degrees.

3. The barricade system of claim 2 wherein said stanchion includes a second other slot, said second other slot intersecting said first other slot first segment at an angle less than 90.

4. The barricade system of claim 3 wherein said stanchion second other slot is disposed so as to intersect said first other slot first segment outside of the perimeter of said stanchion.

5. The barricade system of claim 4 wherein said stanchion second other slot comprises two segments, said segments intersecting one another at an angle greater than 90 and less than 180 degrees.

6. The barricade system of claim 5 wherein said stanchion first other slot first and second segments are disposed at the same angle with respect to the first and second perpendicular slots, respectively.

7. The barricade system of claim 6 wherein the angle at which each of the first and second segments of the first other slot intersect the perpendicular slots is between 20 and 25 degrees.

8. The barricade system of claim 1 wherein said stanchion is substantially rectangular and said each of said perpendicular slots is parallel to one of two adjoining edges of said stanchion.

9. The barricade system of claim 8 wherein said stanchion perpendicular slots intersect on a diagonal line that connects one corner of said stanchion to the opposite corner.

10. The barricade system of claim 9 wherein said intersection of the first and second segments of the first other slot is on said diagonal.

11. The barricade system of claim 10 wherein said intersection of the first and second segments of the second other slot is on said diagonal.

12. The barricade system of claim 2 wherein each of said slots and each of said segments are linear.

13. The barricade system of claim 12 wherein each of said slots has a rectangular cross-section.

14. The barricade system of claim 13 wherein each of said elongated bars are rectangular in cross section.

15. The barricade system of claim 14 wherein each of said bars are rigid.

16. The barricade system of claim 15 wherein said bars are received in said slots with a press fit.

17. The barricade system of claim 16 wherein said stanchion is formed of plastic.

18. A fence system to prevent a child in a wheeled vehicle from bumping into valuable objects within a house or other area that has a relatively flat riding surface comprising a plurality of posts and horizontally disposed bars, each of said posts positioned in spaced relation around the object to be protected and resting on the surface and including means for resisting movement of the post from the position at which said post is initially positioned, said post having a generally rectangular shape and a top section having a plurality of linear channels that extend from one edge of the section to another; and each of said bars being elongated and rigid, the ends of each bar received in one of the channels in the spaced apart posts so as to form a continuous fence surrounding the protected object.

19. A protection system to prevent wheeled vehicles from making contact with an object comprising a plurality of supporting means and elongated rigid stop means, each of said stop means having one end resting on one of said supporting means and the other end resting on another spaced apart supporting means, each of said supporting means including a plurality of rest means, each of said rest means comprising an elongated opening for receiving the end of one of said stop means at least one of said openings extending from one of the edges to the other edge, each of said openings disposed at an angle to at least one of the other openings, whereby a series of said supporting means and stop means form a fence of selected shape and length.

* * * * *